United States Patent [19]

Thomas

[11] 4,236,041

[45] Nov. 25, 1980

[54] STEREOPHONIC SIGNAL INDICATING APPARATUS

[75] Inventor: Richard D. Thomas, Acton, Mass.

[73] Assignee: H. H. Scott, Inc., Woburn, Mass.

[21] Appl. No.: 29,729

[22] Filed: Apr. 13, 1979

[51] Int. Cl.[3] ..... H04H 5/00

[52] U.S. Cl. ..... 179/1 GN; 179/1 GB

[58] Field of Search ..... 179/1 GN, 1 GB, 1 G, 179/1 GS, 100.4 ST, 100.1 TD; 325/398, 36

[56] References Cited

U.S. PATENT DOCUMENTS

| | | | |
|---|---|---|---|
| 3,206,550 | 9/1965 | Fink | 179/1 GN |
| 3,293,366 | 12/1966 | Golonski | 179/1 GN |

FOREIGN PATENT DOCUMENTS

| | | | |
|---|---|---|---|
| 2223432 | 12/1973 | Fed. Rep. of Germany | 179/1 GN |
| 2535494 | 2/1977 | Fed. Rep. of Germany | 179/1 GN |

*Primary Examiner*—Douglas W. Olms

*Attorney, Agent, or Firm*—Rines and Rines, Shapiro and Shapiro

[57] ABSTRACT

This disclosure is concerned with resolving monophonic-stereophonic signal reception indication ambiguities through the development of channel difference signals, by appropriate filtering and compression, that distinguish the stereophonic mode.

5 Claims, 3 Drawing Figures

STEREOPHONIC SIGNAL INDICATING APPARATUS

Figure 1:
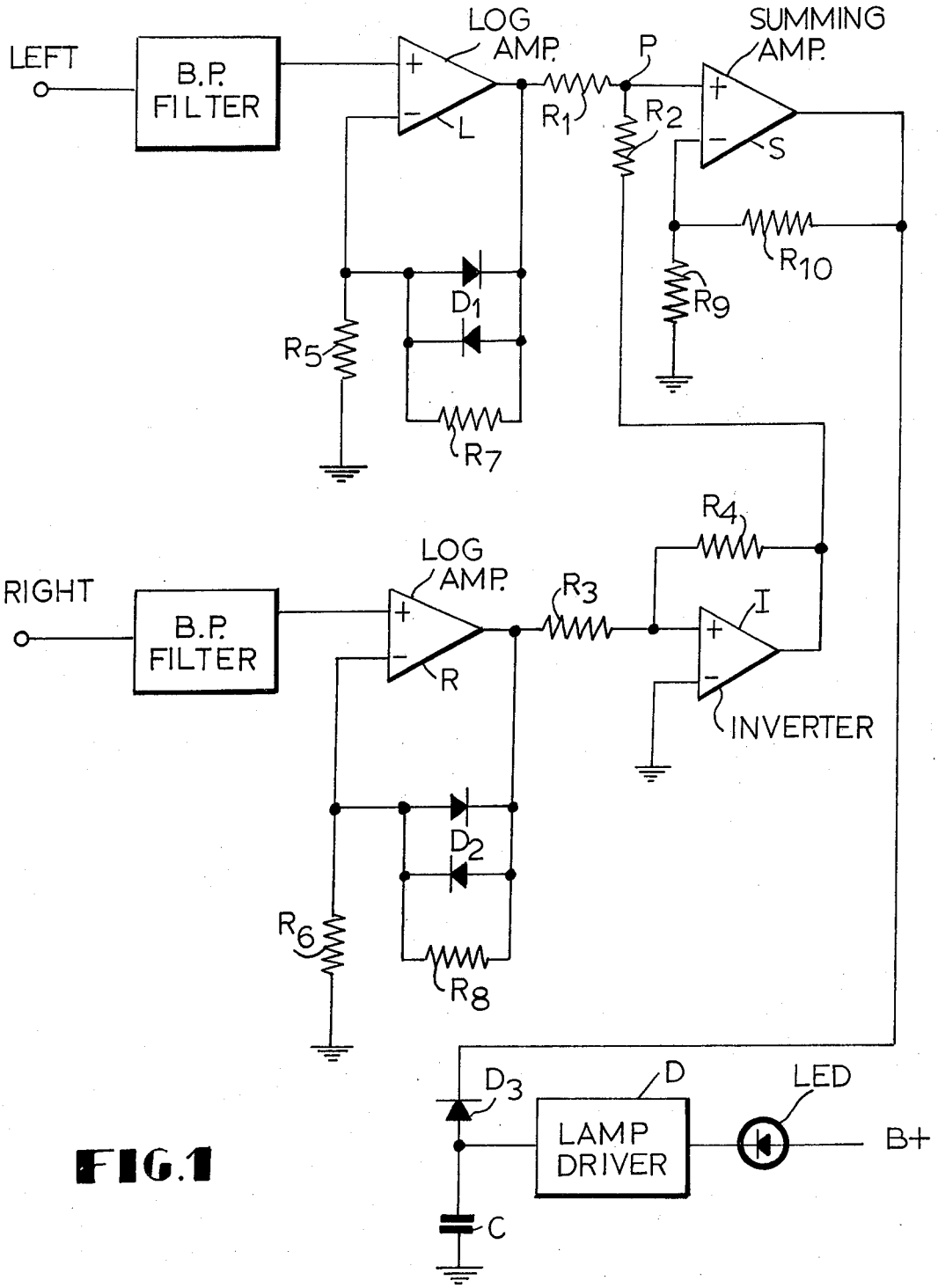

The present invention relates to apparatus for indicating the transmission of stereophonic broadcasting signals and the like, being more particularly adapted for use in stereophonic high-fidelity frequency-modulated (FM) receivers.

In normal operation, frequency-modulation stations transmit a main channel audio-frequency-modulated signal of a carrier of the order of, say, 100 megahertz. When not simultaneously broadcasting stereophonic signals, the station may be transmitting background music or similar monophonic signals, in conventional multiplex fashion, as from early phonograph records or the like. In order to alert the user of a receiver to the fact that the receiver is tuned to a pair of stereophonic broadcast signals, as by an indicator light or the like, resort has generally been made to monitoring the 19-kilohertz pilot signal, which is frequency-modulated and transmitted simultaneously with the main channel audio signal upon the FM carrier. A 38-kilohertz subchannel carrier containing a second audio signal, constitutes, with the main-channel audio signal, a pair of stereo signals. The 19-kilohertz pilot signal enables generation of the 38-kilohertz re-insert carrier at the receiver in order to enable the separation of the stereophonic transmission.

An example of the utilization of the presence of the 19-kilohertz pilot signal as an indicator of stereo signal transmission is presented in U.S. Pat. No. 3,125,641 of the assignee of the present application, H. H. Scott, Inc. Other examples of this general approach to stereo signal broadcast indication are contained in U.S. Pat. No. 3,125,640 and 3,161,727.

Still other examples of systems for indicating similarly desired transmissions are described, as further illustrations, in U.S. Pat. Nos. 3,206,550; 3,247,321; 3,388,220; 3,679,979; 3,732,498; 3,896,386; and 3,696,301.

While, broadly speaking, it has previously been proposed, as in the above-mentioned U.S. Pat. No. 3,206,550, to discriminate between monophonic and stereophonic transmission by monitoring a signal that only exists in stereophonic transmission, there are still instances where considerable ambiguity exists in the so-called stereophonic indicating procedure, and in which stereophonic signals are actually not being transmitted, though the user is receiving a false indication to the contrary. Under present day practice, for example, the station may well leave the pilot tone signal on, while playing monophonic records, or providing other monophonic programs which would then falsely be indicated as stereophonic transmissions as a result of a response to the pilot tone. While a comparator circuit comparing the two channel signal transmissions can, under certain ideal conditions, indicate the presence of stereophonic transmissions as distinguished from identical monophonic signals, as discussed in said U.S. Pat. No. 3,206,550, for example, such comparison systems are unreliable in the event of low modulation levels.

The present invention is, accordingly, directed to the solution of the relatively long-standing problem of providing more reliable and unambiguous indication of the presence of stereophonic transmissions, and better discriminating from all other types of transmissions including monophonic transmissions; and this, irrespective of whether the pilot tone may be inadvertently continued during non-stereophonic transmission.

It is thus a further object of the invention to provide a new and improved stereophonic signal indicator that is not subject to the limitations of the prior art aproaches, including those above-described, but that, to the contrary, with inexpensive circuitry, can provide a new degree of reliability in reception indication.

While specifically described in connection with its important application to stereophonic broadcasting, moreover, it will be evident that the techniques of the invention may also be useful with other types of signals wherein the advantages of the present invention are also sought; it being a further objective of the invention, accordingly, to provide a new and improved signal discriminator system of more general applicability, as well.

Other and further objectives will be explained hereinafter and are more particularly pointed out in the appended claims. In summary, however, viewing the invention in the light of its preferred application to the indication of the transmission of stereophonic broadcasting signals, the invention contemplates apparatus having, in combination, a pair of similar filter means, one connected to receive each of a pair of signals; a pair of similar signal compression means, one connected to each of the filter means, for compressing the respective filtered signals; phase inverter means connected to one of the signal compression means and to a terminal in common with the output of the other signal compression means; summing and detecting means connected with said common terminal for producing a d.c. voltage indicative of the resultant signal at the said common terminal which is significantly different for stereophonic and monophonic signal inputs to the compression means; and means connected to said summing and detecting means and responsive to said d.c. voltage for indicating the reception of stereophonic pairs of signals. Preferred details are hereinafter presented.

Figure 2:
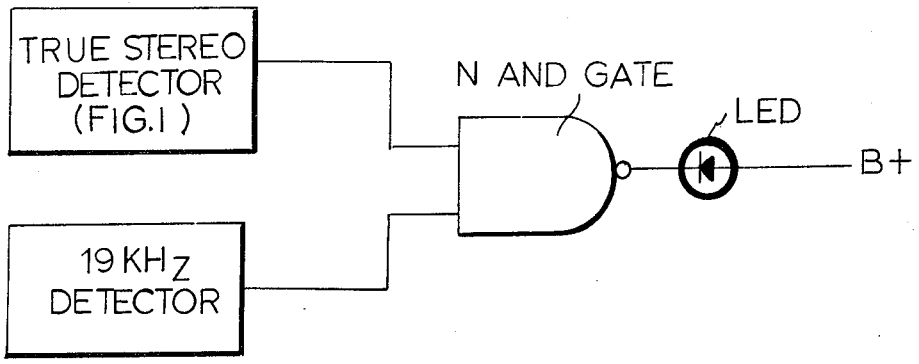
Figure 3:
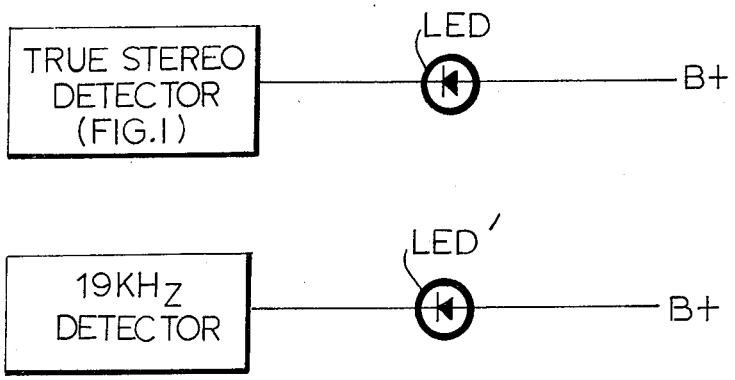

The invention will now be described with reference to the accompanying drawings, FIG. 1 of which is a combined block and schematic circuit diagram illustrating a principal feature of the invention in preferred form;

FIG. 2 is a block diagram of a modified system incorporating the 19-kilohertz pilot tone detector as well; and FIG. 3 is a similar view of a modification.

Referring to FIG. 1, the left and right channel signals that have been received in the FM stereo receiver multiplex decoder, are shown applied at terminals labelled "left" and "right" to similar band pass filters ("BP filter") adjusted, for example, to provide uniform response from about 300 to 6000 hertz. These signals are fed to the input of a pair of similar compression circuits, illustrated in the form of operational amplifiers L and R, modified to operate as logarithmic amplifiers in order to enable signal compression, preferably of dynamic range of the order of 65 db. This operation is attained by placing a pair of diodes $D_1$, connected in parallel but in opposite polarity directions, between the output and input of the operational amplifier L, with shunt resistor R7 limiting the gain for low signal reception and grounded resistor R5 stabilizing the gain of the circuit over the above-mentioned dynamic range requirements. The "right" channel logarithmic amplifier R is similarly provided with diodes D2 and shunt resistor R8 connected between input and output, and with input grounded resistor R6 corresponding to the similar components described in connection with amplifier L.

The output of amplifier R is fed via series resistor R3 to a phase inverter I, having an output-to-input feedback resistor R4 and a series output resistor R2 that is connected to the series output resistor R1 of amplifier L at point P. The output of amplifier L and the 180° phase-inverted output of amplifier R at P are summed in summing amplifier S, the resistor network R9 and R10 of which is used to set the gain of the summing amplifier for application to diode D3 and capacitor C which provide dc level detection of the summing amplifier output. The resulting dc voltage drive is applied to a lamp driver stage D which may drive any suitable indicator device such as an LED, a lamp or other suitable indicator device.

This circuit, in practice, is capable of detecting signal differences of approximately 5 db or more; and with proper adjustment, reliable indication is achievable to approximately 60 db down. In the event of monophonic transmissions, on the other hand, zero voltage will result (ideally) at the sum point P of R1 and R2. For stereo transmissions, on the other hand, a voltage will be developed at P dependent upon the degree of separation between channels; say, of the order of several hundred millivolts. Even when the cancellation of monophonic signal is imperfect, moreover, the signal strength is significantly less so that discrimination from monophonic transmission is thus attained. While there may be transient moments when musical signals or the like, transmitted as a stereophonic pair, are almost equal, the integrating capacitor C will in such instances avoid flicker of the indicator LED.

If monophonic transmissions should in some rare circumstances occur that produce signal differences indistinguishable from stereo transmissions (say, 5 db difference between channels), such would occur without the presence of the 19-kilohertz pilot tone, and this ambiguity can readily be resolved by systems such as shown in FIGS. 2 and 3.

In FIG. 2, the illustrated circuit employs the previously described true stereo detector of FIG. 1 in conjunction with a 19-kilohertz pilot tone detector. The output from these two detectors may be applied to a logical N and gate which will turn on the indicator only in the presence of both the 19-kilohertz pilot tone and the stereo sum or difference signal. Alternatively, in the embodiment of FIG. 3, the said true stereo detector and the 19-kilohertz pilot tone detector may respectively drive two separate indicating devices LED and LED', thereby allowing the user to determine the presence of the pilot tone and stereo source material independently.

Either or both of the above circuits, furthermore, may also be provided with another indicator, not shown, to indicate monophonic sums information in the absence of stereo information as is well known and described, for example, in the first-mentioned Letters Patent. The invention may also be used with stereophonic AM broadcast receivers, and is applicable to any stereophonic system including phonograph and magnetic tape equipment.

Further modifications will also occur to those skilled in this art and such are considered to fall within the spirit and scope of the invention as defined in the appended claims.

What is claimed is:

1. In stereophonic signal receiving apparatus and the like provided with means for receiving pairs of signals and a pilot tone signal transmission, apparatus for indicating if said pairs of signals are stereophonic transmissions, said apparatus having, in combination, a pair of similar filter means, one connected to receive each of the said pairs of signals; a pair of similar signal compression means, one connected to each of the filter means, for compressing the respective filtered signals; phase inverter means connected to one of the signal compression means and to a terminal in common with the output of the other signal compression means; summing and detecting means connected with said common terminal for producing a d.c. voltage indicative of the resultant signal at the said common terminal which is significantly different for stereophonic and monophonic signal inputs to the compression means; means connected to said summing and detecting means and responsive to said d.c. voltage for indicating the reception of stereophonic pairs of signals; means for detecting said pilot tone signal transmission; and means for indicating stereophonic signal reception if both the said d.c. voltage and pilot tone detection are present.

2. Apparatus as claimed in claim 1 wherein said compression means comprises a pair of similar logarithmic amplifiers.

3. Apparatus as claimed in claim 1 wherein said pair of similar filter means comprise band-pass filters.

4. Apparatus as claimed in claim 1 and in which said indicating means comprises a pair of indicators separately responsive to each of the d.c. voltage and pilot tone detection.

5. Apparatus as claimed in claim 1 and in which said indicating means comprises common indicator means responsive to the simultaneity of both the said d.c. voltage and the pilot tone detection.

* * * * *